United States Patent [19]

Bergman et al.

[11] 4,064,658

[45] Dec. 27, 1977

[54] BRUSH ROUNDATOR

[75] Inventors: John E. Bergman, Huntington Bay; William T. Keeler, E. Meadow; Patrick J. McKenna, West Babylon, all of N.Y.

[73] Assignee: Blair Tool and Machine Corporation, College Point, N.Y.

[21] Appl. No.: 721,726

[22] Filed: Sept. 9, 1976

[51] Int. Cl.[2] ..... B24B 7/20

[52] U.S. Cl. ..... 51/110; 51/DIG. 17

[58] Field of Search ..... 51/110, 112, 76, 80 A, 51/DIG. 17; 300/17

[56] References Cited

U.S. PATENT DOCUMENTS

| | | | |
|---|---|---|---|
| 1,792,829 | 2/1931 | Goin | 51/110 |
| 1,857,832 | 5/1932 | Bailey | 51/80 A |
| 2,080,198 | 5/1937 | Brandenburg | 51/110 |
| 2,715,796 | 8/1955 | Beard | 51/110 X |
| 3,233,943 | 2/1966 | Peterson | 300/17 |
| 3,295,261 | 1/1967 | Murray | 51/76 R X |
| 3,315,786 | 4/1967 | Hazelton | 198/627 |
| 3,451,173 | 6/1969 | Hazelton | 51/110 |

*Primary Examiner*—James L. Jones, Jr.
*Assistant Examiner*—Nicholas P. Godici
*Attorney, Agent, or Firm*—Griffin, Branigan and Butler

[57] ABSTRACT

A brush roundator comprises an endless conveyor for conveying brushes along a straight path in one direction. The brushes are mounted to the conveyor with their bristles extending outwardly away from the conveyor. A plurality of abrasion disc series, or groups, each including a plurality of abrasion discs arranged side-by-side in a line are positioned parallel to the conveyor and in the paths of the outer tips of the bristles. Each of the disc series is mounted on a frame whose position can be adjusted independently of the frames of the other series, both angularly and/or linearly. Each disc series includes a motor mounted on the frame to drive a first abrasion disc of the series and that disc has a gear thereon which meshes with a gear of an adjacent abrasion disc to rotate it in the opposite direction. This gear is linked to a gear of a next adjacent abrasion disc in a similar manner to rotate it in an opposite direction and so on.

12 Claims, 4 Drawing Figures

BRUSH ROUNDATOR

BACKGROUND OF THE INVENTION

This invention relates broadly to the art of brush making, and, more particularly to machines for rounding the tips of individual brush bristles.

Prior-art patents which relate to this invention include U.S. Pat. Nos. 2,854,797 to Clief, 3,063,204 to Baumgartner, 3,355,839 to Clemens, 3,384,418 to Guey et al., and 3,451,173 to Hazelton.

Hazelton describes a machine for finishing paint brushes. In this respect, Hazelton's machine is not concerned with rounding individual brush bristles, but rather forming the overall tapered or chiseled configuration on a paint brush. In this respect, the machine continuously feeds brushes 16 below large abrasive members, or sanding discs 37. The discs are driven to rotate in the same direction and are rather large in order to produce flat but tapered shapes at the ends of brushes. Such a machine is not satisfactory for merely rounding the tips of individual bristles since it changes the contour of the overall brush. Thus, it is an object of this invention to provide a brush bristle roundator which rounds, or dulls, the tips of individual bristles, and which maintain an existing overall brush contour.

Clief and Clemens, on the other hand, describe machines for rounding the tips of bristles which have not yet been mounted in brush backs. That is, the bristles are maintained in tufts during the rounding process. These machines are not totally satisfactory in that they require a rather complicated structure for holding the tufts while they are being rounded. Further, they are relatively slow in operation since the bristle tips of each tuft must be individually processed. Thus, it is an object of this invention to provide a brush bristle roundator which is relatively uncomplicated in structure and which can be used to round the bristles of entire brushes at one time.

In Guey et al. and Baumgartner the bristle tips of brushes are held against grinding discs. In Baumgartner the discs are not only rotated but are moved in an eccentric circular path to properly flex the brush bristles. Each successive disc is rotated in an opposite direction. The brushes are carried by a wheel over the centers of the circular paths of the discs. A difficulty with this system is that the complex motions of the discs are jerky in operation, therefore leading to a short lifetime of the overall apparatus. Further, this system, as well as the system of Guey et al., cannot be readily used for brushes whose outer shapes are contoured, such as rounded. Thus, it is an object of this invention to provide a brush roundator that is smooth in operation and which can be used with contoured brushes.

Some prior-art brush roundators have employed brush holders which repeatedly rotate brushes held thereby about axes at brush backs thereof while the bristles thereof are in contact with an abrading disc. Although such a machine can be used for roundating contoured brushes, it is slow in operation and not generally suited for production line manufacturing. Thus, it is an object of this invention to provide a brush roundator which is not only suitable for contoured brushes but also allows high speed production.

SUMMARY OF THE INVENTION

According to principles of this invention, a brush roundator includes a linear endless conveyor for conveying brushes, including brush backs and bristles, along a linear path. A plurality of abrasion disc series, or groups, are positioned in parallel rows along the paths of the outer tip portions of the bristles. The positions of the abrasion disc groups can be adjusted relative to one another, both radially and angularly to conform to various rounded shapes of the brushes. The abrasion discs of each of the groups are driven independently of the abrasion discs of the other groups. In this respect, each abrasion disc group has a motor mounted therewith, and each disc of the abrasion disc group has a gear mounted thereon which meshes with the gear of an adjacent abrasion disc.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
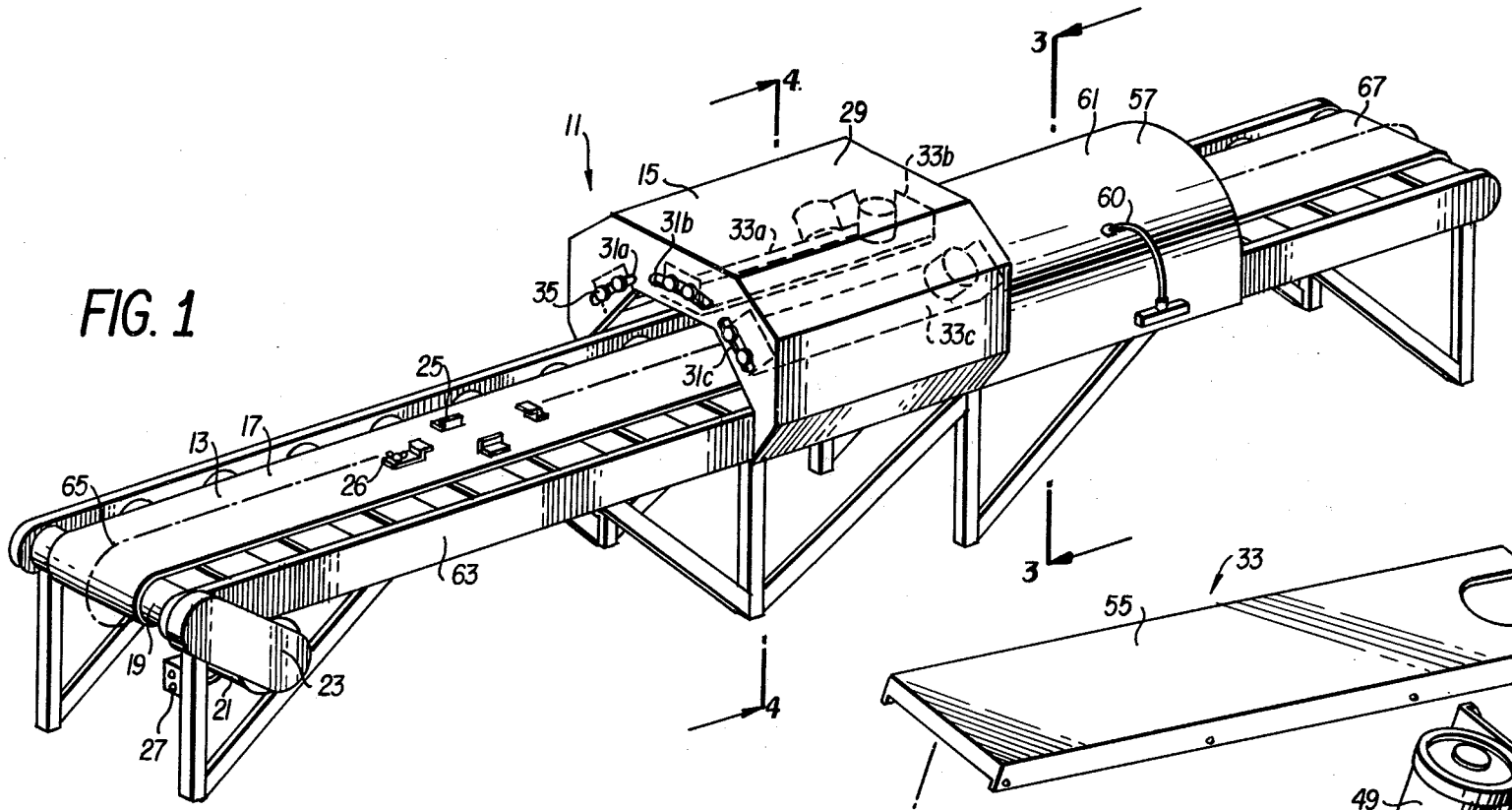
FIG. 1 is an isometric view of a brush roundator employing principles of this invention.
Figure 2:
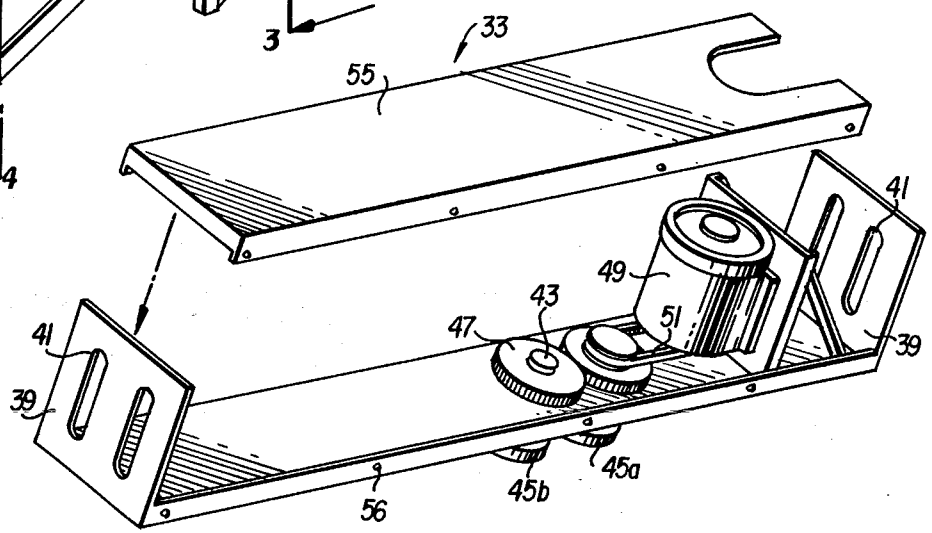
FIG. 2 is an exploded isometric view of a roundating unit in the roundator of FIG. 1.

Referring to the drawings, a brush bristle roundator 11 comprises a linear endless conveyor 13 and a roundating assembly 15.

Figure 3:
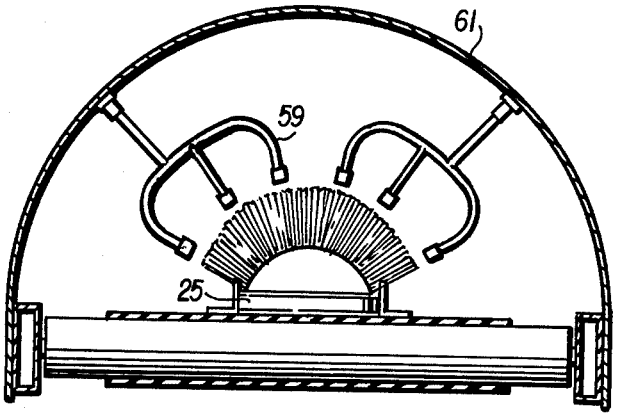
FIG. 3 is a sectional view taken on line 3—3 in FIG. 1.

The linear endless conveyor 13 includes a belt 17, a driving roll 19, a motor 21, and linkage 23 between the motor 21 and the driving roll 19. The belt 17 includes a series of clamps 25 (only one set shown for simplicity) thereon for clamping brush backs to the belt 17 so that the brush bristles extend upwardly as is depicted in FIG. 3. The clamps 25 are depicted as being adjustable on the belt 17 by means of wing nuts 26, however, other fasteners can also be used.

The motor 21 is a variable speed motor which can be controlled by a control unit 27 to cause the belt 17 to convey brushes at various speeds.

The roundating assembly 15 includes an outside frame 29 positioned over the belt 17 to form a "tunnel" through which the belt 17, and brushes mounted thereon, pass. There are slots 31 in each end of the outside frame arranged in the shape of an arc about the belt 17. Each of the slots **31*a*, 31*b*, and 31*c*, extends approximately 45° about the belt 17, with the slot 31*a* being positioned on one side of the belt, the slot 31*b* being positioned above the belt, and the slot 31*c*** being positioned on the opposite side of the belt.

Roundator units **33*a*, 33*b*, and 33*c* are respectively mounted at the slots 31*a*, 31*b*, and 31*c* by means of machine bolts 35. In this respect, the roundator units 33 can be moved along their respective slots 31** to adjust their positions relative to rounded contours of brushes as is explained below.

Because each of the roundator units 33 is identical with the other units, only one of the units will be described. The unit includes an elongated frame 37 having uprights 39 at the opposite ends thereof. The uprights 39 have slots 41 therein which can be used to adjust the distance of the elongated frame 37 from brushes mounted on the belt 17. In this respect, the machine bolts 35 pass through a slot 31*a, b,* or *c* and through the slots in the upright 39. When the machine bolts 35 are loosened the elongated frame's angular position about the outside frame 29 can be adjusted within the slot 31 and its distance from the brushes can be adjusted within the slots 41. In addition, the elongated frame 37 can be rotated to some extent about an axis extending longitudinally along the elongated frame 37.

Shafts 43 of abrasion discs 45 are journaled in the elongated frame 37. The shafts 43 are fixedly attached to the abrasion discs 45 on one side of the elongated frame 37 and are fixedly attached to gears 47 on the opposite side of the elongated frame 37. It should be noted that the abrasion discs 45 are arranged along the elongated frame 37 in a line which, when the elongated frame 37 is mounted to the outside frame 29, is parallel to the direction of travel of the belt 17. In the preferred embodiment, there are only two abrasion discs, however, more abrasion discs can be used. The respective gears 47 of the adjacent abrasion discs 45 mesh so that if one of the gears is driven, it, in turn, drives the other gear(s), with the adjacent gears being driven in opposite directions. In this respect, a disc motor 49 is also mounted on the elongated frame 37 to drive a first abrasion disc 45*a* via a toothed belt 51. A gear cover 55 is attached to the sides of the elongated frame 37 by means of screws (not shown) at holes 56.

A cleaning blower 57 is positioned downstream of the roundating assembly 15. The cleaning blower 57 includes nozzles 59 (FIG. 3) which are directed toward brushes conveyed by the belt 17. The nozzles 59 are fed by hoses 60. The nozzles 59 expel pressurized air to blow dust from the brushes which results from operation of the roundator. The cleaning blower 57 includes a cover 61 which encloses the belt 17 and which supports the nozzles 59. The cover 61 is attached to a main conveyor frame 63.

Figure 4:
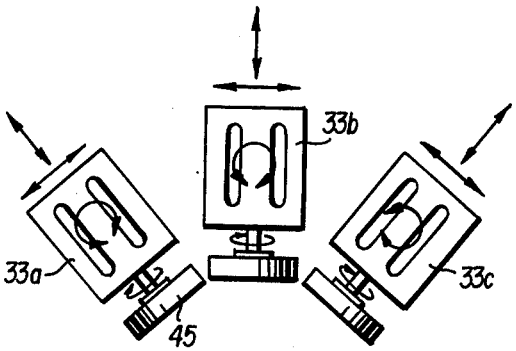
FIG. 4 is a fragmented, sectional view taken on line 4—4 in FIG. 1.

In operation, brushes whose individual bristles are to be rounded are clamped to the belt 17 at a first end 65 of the belt 17 and conveyed toward an opposite end 67. The abrasion discs' positions are adjustable as is depicted in FIG. 4. As is described above, each of the roundator units 33 can be adjusted independently of the other roundator units 33 so that their respective abrasion-disc groups correspond to the contours of the brushes. The brushes are conveyed on the belt through the brush bristle roundating assembly 15. As the tip portions of the bristles contact first abrasion discs 45*b*, they are bent in a first direction to abrade or smooth first sides of the bristle tips. However, once the bristles pass the centers of the first discs, 45*b* they are bent back in the opposite direction by motion of the discs 45*b* to abrade the opposite sides of the bristle tips. This process is repeated as the bristles pass each abrasion disc 45. The brushes are thereafter conveyed through the cleaning blower 57 where dust from the brush bristle roundator 11 is blown from the brushes. The brushes are then removed from the belt 17 at an end 67 thereof.

It should be appreciated by those skilled in the art that since the abrasion discs 45 are relatively small, the abrasion disc groups have sufficient room between them that they can be adjusted both angularly and vertically relative to one another to conform to the contours of brushes. In this regard, the abrasion discs will normally be adjusted so that their axes are parallel to the brush bristles they are to round. Such a machine has far greater flexibility than previous machines where brush bristles are brought into contact with single discs.

It will be further appreciated that by mounting individual motors on each of the roundator units 33 the units can be more easily made adjustable relative to one another. In addition, by using small discs, single gears mounted on each of the discs can be used to drive adjacent discs. This is an improvement over prior-art systems where larger, more complicated, and noisy gear systems were necessary. The smaller, and fewer, gears of this system reduce the noise created by the machine and contribute to increased durability of the overall machine.

As was mentioned above, the conveyor motor 21 is of variable speed so that the belt 17 can be driven at various speeds. This also adds to the flexibility of the overall machine because the brushes can be conveyed past the abrasion discs 45 at various speeds to achieve varying degrees of roundation. In this respect, an operator can account for various types of materials used for the bristles to achieve a uniform degree of roundation among the different types.

While the invention has been particularly shown and described with reference to a preferred embodiment, it will be understood by those skilled in the art that various changes in form and detail may be made therein without departing from the spirit and scope of the invention. For example, various structures other than the slots 31 and 41 could be used for adjusting the positions of the abrasion disc groups. Further, fastening means other than the clamps 25 could be used for fastening the brush backs onto the belt 17. In this respect, the belt 17 itself could be replaced by chains or other types of endless conveyors. It should be appreciated that the device depicted and described herein can be adjusted to round the tips of brushes whose bristles are vertically parallel rather than extending radially as do the bristles of the brush depicted in FIG. 3.

The embodiment of the invention in which an exclusive property or privilege are claimed are defined as follows:

1. A brush roundator for dulling the tips of brush bristles which are mounted on brush backs comprising:

a conveyor for conveying along a straight path said brush backs having said brush bristles mounted thereon, said conveyor including fastening members for fastening said brush backs to said conveyor with said bristles extending outwardly away from said conveyor;

a plurality of abrasion disc series, each of said abrasion disc series including a plurality of abrasion discs arranged side-by-side, parallel to said conveyor and in the paths of the outer tip portions of said bristles, said discs having axes of rotation;

said plurality of abrasion disc series including a mounting means for arranging said disc series parallel with one another, but allowing them to be angularly displaceable as units from one another about said conveyor so that the disc axes can be adjusted to be approximately parallel with the bristles they are in the paths of.

2. A brush roundator as in claim 1 wherein each of said disc groups is mounted on an elongated frame that is angularly movable relative to the frames of the other disc series.

3. A brush roundator as in claim 2 wherein each of said disc series includes a motor mounted on the frame thereof.

4. A brush roundator as in claim 3 wherein each of said abrasion discs has a gear attached thereto which meshes directly with a gear attached to an adjacent disc to rotate in an opposite direction from said adjacent disc.

5. A brush roundator as in claim 4 wherein said elongated frames include an adjusting means for adjusting the distances of said elongated frames from brush backs conveyed by said conveyor.

6. A brush roundator as in claim 5 wherein said conveyor includes a speed adjusting means for adjusting the speed at which said conveyor conveys said brush backs past said disc series.

7. A brush roundator as in claim 1 wherein each of said disc series includes an adjustment means for adjusting the distances of said elongated frames from brush backs conveyed by said conveyor.

8. A brush roundator as in claim 1 wherein said conveyor includes a speed adjusting means for adjusting the speed at which said conveyor conveys said brush backs past said disc series.

9. A brush roundator for dulling the tips of brush bristles which are mounted on brush backs comprising:

a conveyor for conveying in a straight line said brush backs having said brush bristles mounted thereon, said conveyor including fastening members for fastening said brush backs to said conveyor with said bristles extending outwardly, away from said conveyor, said conveyor also including a speed adjusting means for allowing selective adjustment of the speed at which said conveyor conveys said brush backs;

a plurality of abrasion disc groups, each of said abrasion disc groups including an elongated frame having a plurality of discs linearly arranged thereon, side-by-side, each of said elongated frames being mounted on said conveyor by a mounting means parallel to the direction in which the conveyor conveys, said mounting means placing said abrasion discs in the paths of the outer tip portions of said bristles, each of said abrasion disc groups including a motor for driving the abrasion discs of the respective groups independently of the motors of the other groups, each of said abrasion discs having a gear fixedly attached thereto which meshes directly with the gear fixedly attached to an adjacent abrasion disc and one of said gears of each group being driven by the respective motor of that group;

said mounting means including a position adjustment means for allowing the angular positions of said disc series to be adjusted relative to one another and for allowing the selective adjustment of the distance of said disc series from brush backs conveyed by said conveyor.

10. A brush roundator for dulling the tips of brush bristles which are mounted on brush backs comprising:

a conveyor for conveying along a straight path said brush backs having said brush bristles mounted thereon, said conveyor including fastening members for fastening said brush backs to said conveyor with said bristles extending outwardly away from said conveyor;

a plurality of independently adjustable abrasion discs, said abrasion discs being mounted adjacent one another above said conveyor but with their axes pointed inwardly so as to form an arc above said conveyor with one of said abrasion discs being on one side of said conveyor, the other one being directly above said conveyor, and at least another being on the other side of said conveyor;

said plurality of abrasion discs including a mounting means for allowing said discs to be angularly displaceable about said conveyor toward and from one another.

11. A brush roundator as in claim 10 wherein each of said discs is mounted on a separate frame and a separate motor is mounted on each of said discs to drive the respective disc of that frame.

12. A brush roundator as in claim 11 wherein said frames including adjusting means for adjusting the distances of said frames from brush backs conveyed by said conveyor.

* * * * *